United States Patent [19]

Maune

[11] 4,044,503

[45] Aug. 30, 1977

[54] FRAME CONCEALED EXTERIORLY OPENING OPERATING SASH

[75] Inventor: Neil F. Maune, Ladue, Mo.

[73] Assignee: Profile Systems, Inc., St. Louis, Mo.

[21] Appl. No.: 617,637

[22] Filed: Sept. 29, 1975

[51] Int. Cl.[2] ..... E05D 7/06

[52] U.S. Cl. ..... 49/400; 49/501; 49/504; 52/207

[58] Field of Search ..... 49/400–402, 49/501, 504, 485, 488; 52/207

[56] References Cited

U.S. PATENT DOCUMENTS

| | | | |
|---|---|---|---|
| 3,475,863 | 11/1969 | Varlonga | 49/488 X |
| 3,678,626 | 7/1972 | Heikel | 49/402 |
| 3,758,997 | 9/1973 | Vance | 52/207 X |
| 3,878,648 | 4/1975 | Maune | 49/400 |

*Primary Examiner*—Kenneth Downey
*Attorney, Agent, or Firm*—Paul M. Denk

[57] ABSTRACT

In a window construction of the type incorporating particularly operating sash or sashes, and in certain embodiments an operating sash in conjunction with a fixed sash, a perimeter frame surrounds the composite of sashes, and supports an intermediate frame that is arranged between each pair of adjacent sashes. The perimeter frame is constructed of semi-tubular like structure, and that portion of the perimeter frame surrounding the exteriorly opening operating sash includes a formed shoulder that cooperates to form a sealing contact with face flanges integrally connecting to the framework of the operating sash. Where a pair of operating sashes are arranged adjacently within the perimeter frame and intermediate frame, the formed shoulders contact the sash flanges when said sashes are closed, while the back of the sashes exposes a surface that retains a sealing contact with the proximate rear flanges of the perimeter frame when said sashes are maintained in closed position.

14 Claims, 8 Drawing Figures

FRAME CONCEALED EXTERIORLY OPENING OPERATING SASH

CROSS REFERENCE TO RELATED APPLICATION

The subject matter of this application is related to and comprises an improvement upon my invention as disclosed in the U.S Pat. No. 3,878,648, which issued on Apr. 22, 1975, for a Frame Concealed Operating Sash.

BACKGROUND OF THE INVENTION

The invention relates generally to window construction, but more particularly pertains to an exteriorly opening operating sash that is mounted in a manner that provides for uniformity of appearance and concealment of structure therebehind as when viewed from either the interior, and preferably, the exterior of the building in which it mounts.

In my previously identified United States patent therein is defined a window structure of the type that includes operating and fixing sashes that are mounted with a perimeter frame surrounding the opening in a building so as to form its window construction. The essence of that invention is to provide both a narrow line of sight for the combined sash and perimeter frame structure for the window when viewed either exteriorly or interiorly, and at the same time, furnish a zero line of sight due to the concealment of the narrow frame operating structure behind face flanges forming part of the fixed perimeter frame construction. The windows as shown and defined within this earlier patent were designed and constructed for use principally as interiorly opening windows that could be prefabricated and assembled for installation at a building site.

The present invention, recognizing some of the advantages of my earlier teachings with respect to the formation of window constructions from narrow frame structure that also maintain uniformity of appearance and the preferred zero line of sight, is herein concerned with the design of similar structure for use in perfecting an exteriorly opening window, or one which operates directly opposite from that which is set forth in my earlier patent. Obviously, structure must be redesigned from that which is shown in this prior art, since in the said art the various face flanges were formed integrally as part of the fixed structure of the stationary perimeter frame member of the composite sashes, and it was behind these face flanges that the operating components and the tubular like frame members forming the operating and fixed sash structures were concealed. To allow such window construction to be pivoted outwardly obviously entails a redesign of my earlier invention and that is what is to be defined hereinafter.

It is the principal object of this invention to provide a window structure for a building in which either a plurality of operating and/or fixed sashes may be confined within a window framework and in which the facade of the face flanges forming the exterior of the window structure completely conceals any of the operating structure arranged therebehind, even though the operating sashes of this invention are the type that open exteriorly of the building.

It is another object of this invention to provide operating sash window structure that includes narrow face flanges which conceal the operating hardware for the window in addition to the structural means forming the sash structure.

Another object of this invention is to provide an exteriorly opening operating sash that may be used in conjunction with a fixed sash but which provides means for furnishing a very narrow structural appearance to the entire window structure while at the same time insuring the desired zero line of sight of any of the components of the window structure maintained behind the window facade.

An additional object of this invention is to provide structure for a window construction that has a uniform appearance in width dimensions throughout its extent when viewed exteriorly of the building.

Another object of this invention is to provide structure for a window that has uniform width in its composite structure throughout its extent when viewed interiorly of the building structure.

Another object of this invention is to provide a structure for a window of the herein design that maintains sealed contact during closure.

These and other objects will become more apparent to those skilled in the art upon reviewing the summary of this invention, in addition to studying the description of its preferred embodiment in view of its drawings.

SUMMARY OF THE INVENTION

This invention contemplates the structure for a window assembly that may be prefabricated from various metals, usually extruded, then assembled and shipped, or either assembled at the job site, and then installed into the building structure as it is being erected. Particularly, and as previously emphasized, the invention is intended to provide structure for a window that maintains both the narrow profile for the structural components that are of uniform dimension throughout their extent, and yet maintains the preferred zero line of sight behind the structural facade of the window when viewed exteriorly, all of these advantages being attained from window structure incorporating exteriorly opening operating sash, or sashes, or combinations of operating and fixed sashes.

The window structure includes a perimeter frame, made up of mitered and joined frame members, which essentially form the jamb, sill and head portions for the stationary part of the window structure, and which surround the various operating and fixed sashes that are built into the design. Where a pair of operating and/or fixed sashes are incorporated into the window design, an intermediate frame of tubular like structure is designed for spanning the distance between fixed sides of the perimeter frame, whether it be between the sill and head portion, or the two side jamb portions, with the intermediate frame providing support for the overall window structure, in addition to cooperating with the various framing mechanisms that either secure the fixed sash in place, or provide a surface for maintaining sealing closure with a part of the operating sash when said sash is maintained in a closed position.

Essentially, the perimeter frame that forms the jamb, sill and head portions surrounding the operating sash, and thereby forming the operating sash opening therethrough, includes an integral projecting shoulder that cooperates with a face flange integrally formed with the tubular like structure and reglets forming the operating sash, with the cooperation between said shoulder structure and the face flanges of the operating sash providing sealing closure to the sash when maintained in its closed position, while additionally furnishing the desired zero line of sight of any of the structural components of the entire window structure that are maintained rearwardly thereof. In addition, the face flanges that are formed either in the window structure making up the fixed sash opening, or formed as the face flanges that extend outwardly in their integral connection to the structure of the operating sash, are designed having uniformity of width, and at a narrow profile, so that the entire window structure when viewed exteriorly presents uniformity of dimension and streamlined appearance to the overall window structure. The operating sashes formed into the window construction may be hingedly mounted to the perimeter frame so as to provide any variety of directional outward opening, such as either a bottom opening window, top opening window, or even a laterally opening window construction when opened. Such is preferable particularly in those jurisdications that for fire code purposes require that apertures in the building must be both quickly and conveniently opened outwardly, even against one onrush of occupants, such as may occur in an emergency situation as when a fire is encountered.

BRIEF DESCRIPTION OF THE DRAWINGS

In the drawings, FIG. 1 provides an isometric view of an example of the window structure of this invention incorporating operating and fixed sashes.

DESCRIPTION OF THE PREFERRED EMBODIMENT

Figure 1:
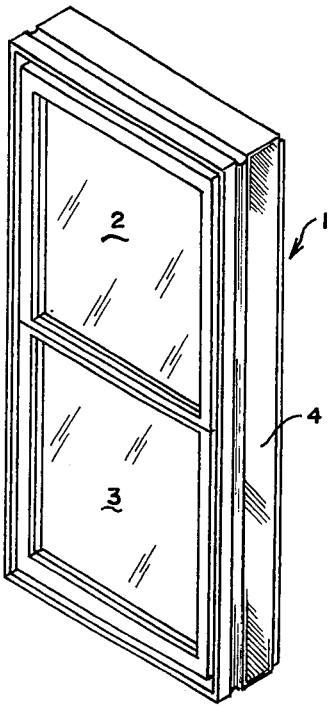
Figure 2:
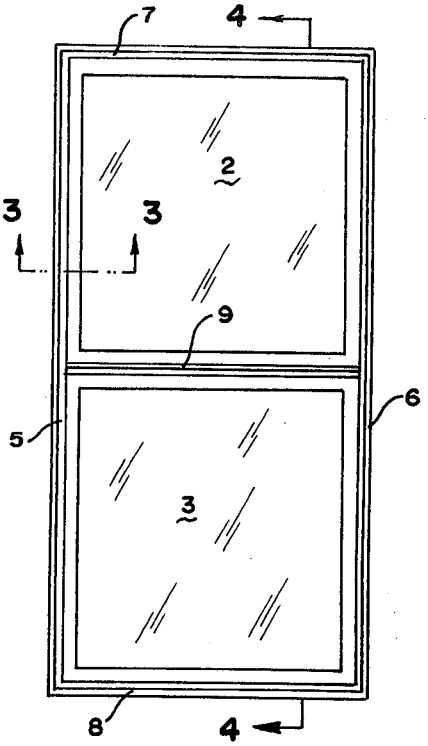
FIG. 2 provides a front view of the window structure of this invention as shown in FIG. 1.

In the drawings, and in referring particularly to FIGS. 1 and 2, there is shown one aspect of the window structure 1 of this invention, which in this particular instance contains an operating sash 2 provided in its upward portion, with a fixed sash 3 being secured into the window structure therebelow. The window structure comprises a perimeter frame 4 that surrounds the periphery of the window, and which frame is comprises of jamb portions 5 and 6, a head portion 7, and a sill portion 8.

These portions are conveniently mitered and joined together at their ends by a series of corner blocks (not shown) as customarily used in the fabrication of structures of this type. Approximately at the midpoint of the perimeter frame is an intermediate frame 9 which spans the distance between the side jambs, being rigidly fastened thereto, so as to provide separation between the operating sash and fixed sash openings and to conveniently provide peripheral frame structure for mounting of these particular sashes.

Figure 3:
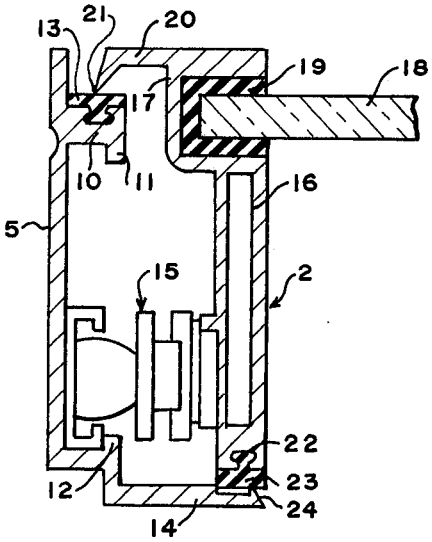
FIG. 3 provides a horizontal sectional view through a jamb portion of an operating sash as taken along the line 3—3 of FIG. 2.

As shown in FIG. 3, the construction of the various frame members making up the perimeter frame and operating sash frame, and the hardware structure pivotally mounting these two members together, are shown. As can be seen, the jamb member 5 is formed of a semi-tubular like structure, which includes a projecting shoulder portion 10 that has a slight rearward extension 11, while the backside of the member 5 includes a forward extension 12, which extensions cooperate to form the semi-tubular or channel like member that provide rigidity to the jamb portion of this perimeter frame, and into which the corner block, as aforesaid may be inserted to hold same frame together.

Obviously this member 5 could be constructed into the tubular shape to add rigidity to this jamb. The frontal portion of the shoulder 10 provides a surface formed so that it may mount a gasket 13, such as one made of neoprene, that may insert so as to provide a sealing surface for cooperating with the operating sash and maintain the same in sealed closure as desired.

The back of said jamb member 5 includes an inwardly extending member 14, in the nature of a rear flange, that is designed to align with the back side of the structure of the operating sash 2 to also maintain the same in sealed contact, as when the window is pivoted closed. Standard hinge structure, as at 15, is provided between the jamb portion 5 and the operating sash 2 so as to provide the focal point for pivoting of the window during its manipulation.

The operating sash 2 is formed of tubular like frame members 16 around its perimeter and includes forwardly thereof an integral reglet 17 for securing the window glaze 18 firmly in place, and a gasket 19 is arranged therein so as to provide sealed retention of the glaze firmly within the frame of the operating sash. Provided integrally across the front of the reglet, and extending outwardly therefrom, is a face flange 20 which is provided with sealing means, such as a contact surface or point 21, at its outer periphery and which can contact into closure with the gasket 13 of the fixed perimeter frame.

The backside of the tubular like member 16 of the operating sash frame 2 is provided with a slot 22 into which another gasket 23 may be inserted and maintained for sealed closure with the contact point or surface 2 provided at the outer edge of the rear flange 14.

As can be seen from the foregoing disclosure, and upon reviewing FIG. 3, the structural components and the hinge hardware of the operating sash are substantially concealed behind the face flange 20 of the window structure as said structure is viewed from the exterior of the building in which it is installed. The face flanges and rear flanges are of substantially narrow width, being somewhat less in width than the entire width from rear to front of the perimeter frame 4, as seen in its jamb portion 5, and thereby provide both a narrow profile and uniformity of appearance in the entire window structure as when viewed, as aforesaid. It may herein be stated that the jamb portion 6 of this perimeter frame, in addition to the proximate tubular like frame of the operating sash contiguous thereto, are a mirror image of the same components as are previously defined in the make up of the jamb portion 5 and the sash structure as just defined.

Figure 4:
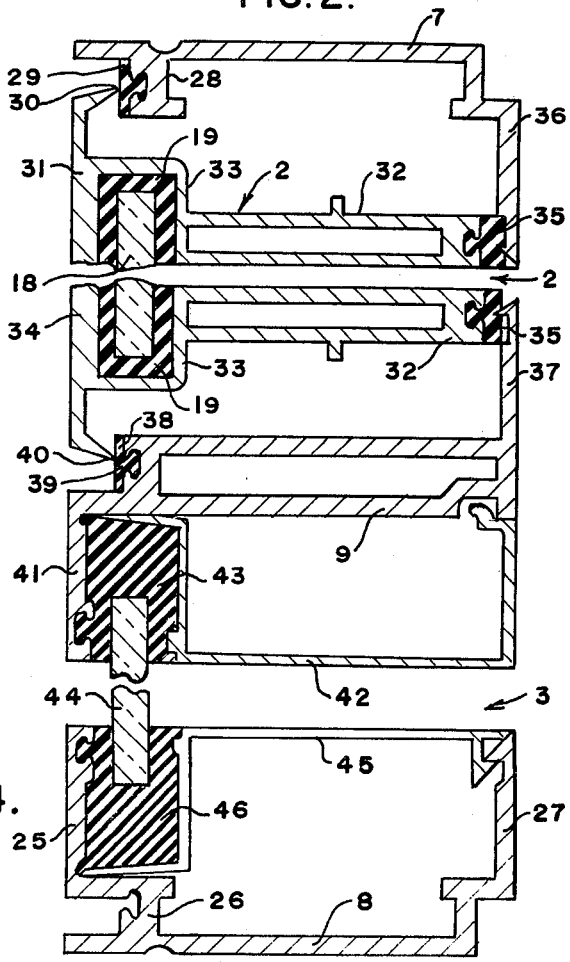
FIG. 4 provides a vertical sectional view through the window structure taken along the line 4—4 of FIG. 2.

FIG. 4 discloses that the structure of the head portion 7 and sill portion 8 are substantially identical in construction to the structure of the jamb portions 5 and 6 as just previously described. The only exception is that where the perimeter frame, and in particular where its sill and jamb portions form the frame for the fixed sash 3 of the window structure, then a face flange, as at 25, extends inwardly from the extension 26 provided integrally projecting from the semi-tubular structure of the perimeter frame, as represented by its sill portion 8. For the purpose of maintaining uniformity of appearance of the entire window structure, regardless whether the sashes may both be of the operating type, or of the combined operating and fixed type sashes, the width of the face flanges 25 are substantially identical to the width of the face flanges 20 previously described as extending integrally around the front of the operating sash 2. Hence, uniformity of width and appearance is provided throughout the window structure as when viewed exteriorly, and since a similar type of rear flange 27 is provided to the backside of the sill portion 8, and which flange is rather identical in construction to the rear flange 14 as previously described, uniformity of appearance to the entire window structure is equally maintained upon the backside of the window structure when viewed from within. The head portion 7 is also provided with the shoulder portion 28, which mounts its gasket 29, so as to furnish a sealed closure when encountering the contact edge 30 formed outwardly of the face flange 31 of the operating sash 2. The operating sash 2, at these upper and lower locations within the window structure are also formed of tubular like members 32, which are equivalent to the tubular like member 16 previously described, and each includes the integral reglets 33 forwardly thereof which secure the gasket 19 for holding the glaze 18 in place. The face flange 31 extends along the top portion of the operating sash structure, and is identical in construction to the face flange 34 maintained along the bottom of the operating sash structure, with both of said face flanges being identical to the vertical face flanges 20 integrally formed to the side of the operating sash structure. The backside of the tubular like frames 32, of the operating sash 2, contain a retained gasket, as at 35, for cooperating with the rear flanges 36 and 37 for providing sealed contact for the operating sash at this location when it is maintained in closure and contacts the flange ends.

Provided spinning the distance across the perimeter frame 4 is the intermediate frame member 9, which also is constructed as a tubular like structure, or any form of reinforced structure, and which disposes a surface 38 to which a gasket 39 may be secured, and which may cooperate with a flange edge 40 of the face flange 34 for likewise maintaining sealed closure at this location for the operating sash. Since this intermediate frame 9 provides a seat for both the operating sash 2, as just previously defined, and the fixed sash 3, obviously it does not possess an upper integral face flange, bur rather, in its place is the surface 38 that cooperates with the face flange 34 provided upon the said operating sash. On the other hand, the intermediate frame 9 also includes the integral and inwardly extending face flange 41 which cooperates with the retainer 42, and the gasket 43, for securing the fixed glaze 44 in place. A similar type of retainer 45 cooperates with the gasket 46 and that face flange 25 for securing the lower edge of the glaze 44 rigidly and permanently in place. This particular style of structure has already been somewhat described in my said previous patent wherein a fixed sash, and its method of mounting, was detailed.

Figure 6:
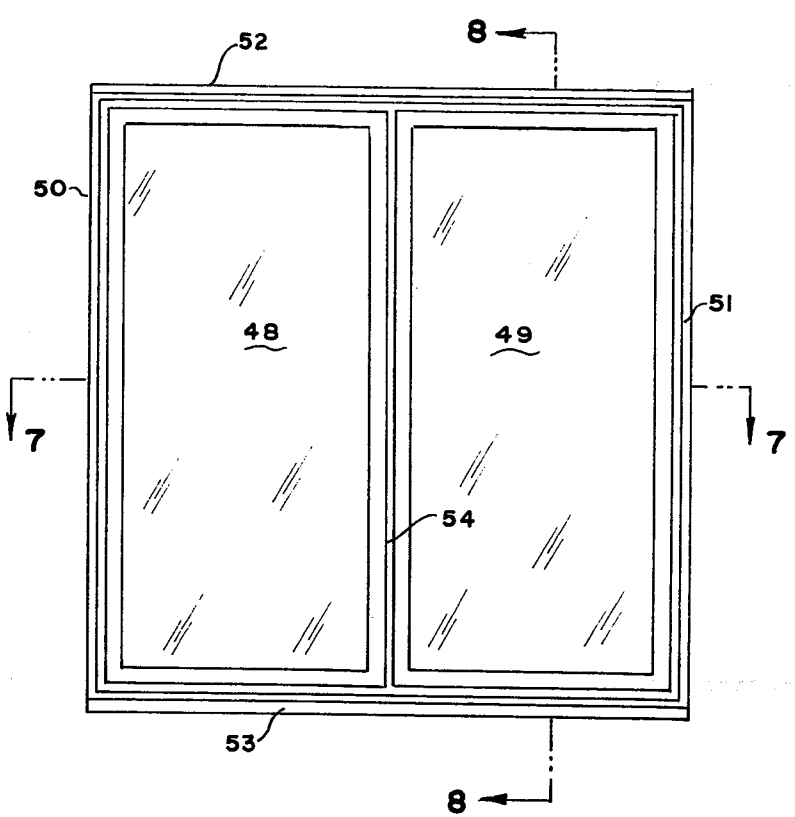
FIG. 6 provides a front view of the window structure of this invention as shown in FIG. 5.
Figure 5:
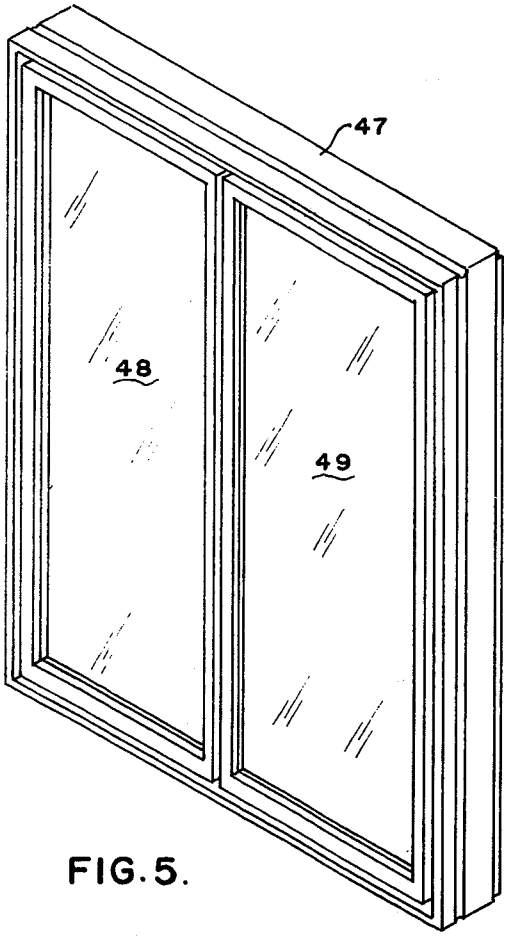
FIG. 5 provides an isometric view of an example of the window structure of this invention incorporating a pair of operating sashes.

The window structure disclosed in FIGS. 5 and 6 comprises a perimeter frame 47 that mounts a pair of operating sashes 48 and 49, which in this particular design, are of the horizontal pivoting window design that open outwardly from their center. This perimeter frame is composed of similar style jamb portions 50 and 51, head portion 52, sill portion 53, and an intermediate vertically extending frame member 54. Obviously, while the intermediate frame 54 is herein shown and described as being vertically arranged within the perimeter frame structure, it could just as likely mount horizontally or transversely within the same so as to separate a pair of upper and lower operating sashes, or even operating and fixed sashes as previously defined with respect to the window structure of FIG. 1.

Figure 7:
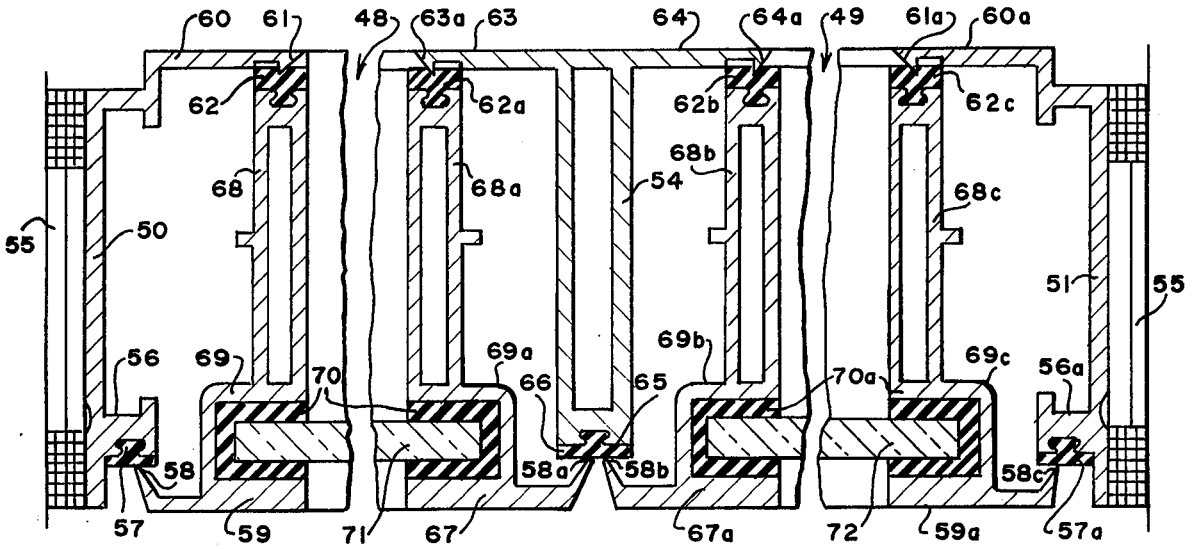
FIG. 7 provides a transverse sectional view of the window structure taken along the line 7—7 of FIG. 6; and, FIG. 8 provides a vertical sectional view of the window structure taken along the line 8—8 of FIG. 6.
Figure 8:
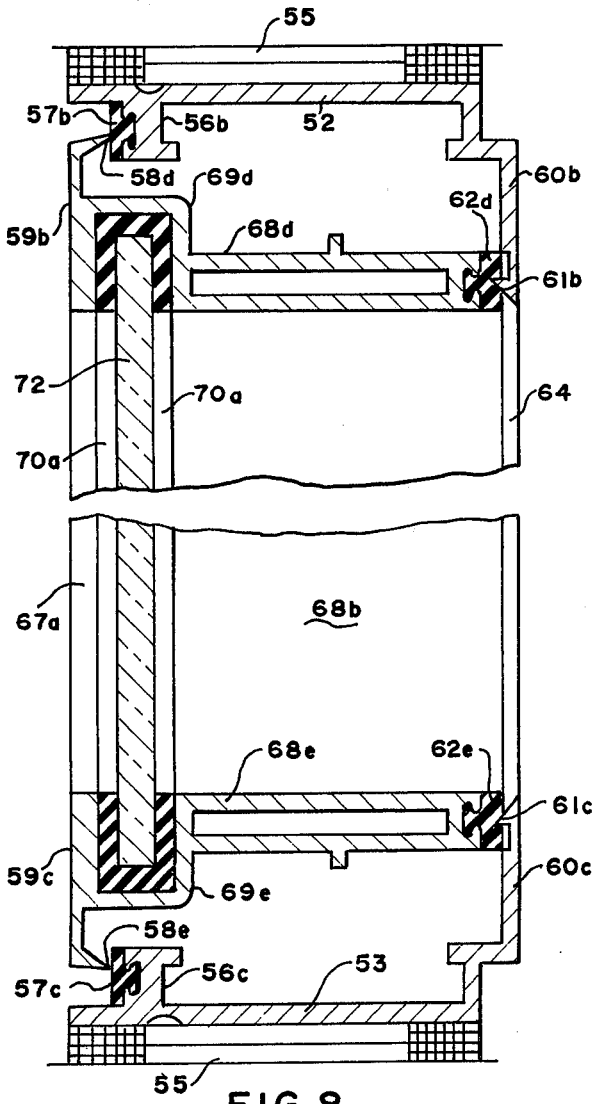

The detailed structure of the various components that make up the perimeter frame and the operating sashes of this invention are very similar in construction to the structure that has already been described with respect to the window of FIG. 1, wherein and as can be seen in FIG. 7, the jamb portions 50 and 51 are secured to the wall structure 55 of the building structure, while the head portion 52 and the sill portion 53 are likewise secured to similar contiguous wall structure. Each of the structures 50 through 53 are formed of semi-tubular like structure, or even tubular structure, usually of extruded metal stock, and include an inward extending shoulder 56 and **56*a*, each which supports a respective gasket 57 and 57*a* that cooperate with a contact edge 58 and 58*c* of the face flanges 59 and 59*a* of the various operating sashes. The back end of each of the portions 50 through 53 include an inwardly extending rear flange 60 through 60*c* that include a contact edge or surface 61 through 61*c* for cooperating with their respective gaskets 62, 62*c*, 62*d*, and 62*e*** provided at the backside of the structure of the operating sashes.

The intermediate frame member 54 is formed of tubular like material, which includes a pair of rear flanges 63 and 64, that extend inwardly of their sash openings, and are aligned for contacting with the gaskets **62*a* and 62*b* which are likewise secured to the rear edge of the frames of their respective operating sashes. Said intermediate frame 54 includes a forwardly disposed surface as at 65 that mounts a gasket 66, that is aligned for being contacted by the contact members 58*a* and 58*b* of the various face flanges 67 and 67*a*** of the pair of operating sashes.

Each of the operating sashes 48 and 49 are formed of tubular like material, as at 68 through **68*e*, around their perimeter, having the gaskets 62 through 62*e* provided at their rearward edges, while the forward edges are integrally formed having reglets, as at 69 through 69*e*, formed around their circumference, with each window formed reglet cooperating with a gasket as at 70 and 70*a*, for supporting their respective glazes 71 and 72. The forward edges of the aforesaid reglets are formed having the face flanges 59 through 59*c*, and 67 and 67*a*, arranged around their perimeter, extending slightly outwardly thereof, with their contact points 58 through 58*e* being aligned for encountering the gaskets 57 through 57*c*, as when these operating sashes are secured into closure. Obviously, since the operating sashes described forming the window structure disclosed in FIGS. 5 and 6 are of the horizontally opening type, conventional hinge means may be provided at the upper and lower lateral positions between the head 52 and sill 53 and their proximate tubular like frames 68*d* and 68*e*** forming the framework for the various operating sashes as defined.

In addition to the foregoing, convention latching means may be utilized for securing these windows firmly in place as when they are locked into closure.

Various modifications to the window structure shown herein and described may be considered by those skilled in the art upon reviewing this disclosure. The description herein provided is of the preferred embodiment, and is set forth for illustration purposes only. Any modifications made to these exteriorly opening sashes for a window structure having the defined uniform appearance and narrow profile, and which may occur to those skilled in the art upon reviewing the disclosure, such modifications as may fall within the spirit and scope of this invention as defined in the appended claims, are intended to be protected by any patent issuing hereon.

Having thus described the invention what is claimed and desired to be secured by Letters Patent is:

1. In a window structure for a building and of the type wherein its window frame presents a narrow profile, and its operating and fixed sashes present a zero line of sight through concealment behind their facades of the uniformly narrow fixed frame and operating sash structure, as when the operating sash is maintained in a closed position, said operating sash being an exteriorly opening sash, said window structure incorporating a glazed fixed sash and a glazed operating sash, a perimeter frame peripherally surrounding said sashes and capable of being permanently mounted to the building structure, an intermediate frame member of reinforced structure provided between said sashes and being fixed to said perimeter frame thereby forming the operating and fixed sash openings, said perimeter frame having jamb, sill, and head portions, said portions being of uniform semi-tubular structure, and when viewed exteriorly along with the intermediate frame member being of uniform dimensions, the glazed operating sash being hingedly mounted to the perimeter frame within said operating sash opening and capable of being opened outwardly with respect thereto, said operating sash being formed as a tubular like frame around its perimeter and having a reglet provided forwardly thereof for securing the glaze firmly in place and to allow its replacement from interiorly of the building, said glazed fixed sash including a retainer being formed of channel like structure around its perimeter, said retainer being removable to allow glaze replacement from interiorly of a building, those portions and the intermediate frame forming the fixed sash opening and the reglet of the operating sash having integral face flanges extending inwardly and outwardly respectively thereof, said face flanges having a width substantially less than the width of said portions and the intermediate frame member, said face flanges on said portions and the intermediate frame forming the fixed sash opening cooperating to form a continuous seat for the fixed sash glaze thereagainst their interior for holding said glaze firmly in place, said operating sash when maintained in closed position having its face flanges substantially concealing its tubular like frame and the perimeter frame therebehind, in addition to said fixed sash being substantially concealed behind its proximate face flanges as the window structure is viewed exteriorly.

2. The invention of claim 1 wherein said operating sash hingedly connects proximate its top edge to the perimeter frame thereby providing for the pivotal opening outwardly of its bottom portion with respect to said frame.

3. The invention of claim 1 and including rear flanges extending inwardly from the inner edges of said perimeter frame, with said rear flanges being disposed in contiguity with and substantially concealing the rearward edges of the operating and fixed sash frames as retained proximate thereto, said rear flanges being substantially arranged in alignment with the face flanges of the perimeter and operating sash frames.

4. The invention of claim 3 wherein said face flanges have a width of less than one half the width of said jamb, sill and head portions.

5. The invention of claim 1 and wherein the perimeter frame portions and the intermediate frame forming the operating sash opening includes a formed shoulder around its periphery, the face flanges of the operating sash retaining a sealing contact with said shoulder as when said sash is maintained in closed position.

6. The invention of claim 1 and including a gasket seating within the reglet formed around the operating sash perimeter for securing the edges of the embraced glaze.

7. The invention of claim 3 wherein said rear flanges include contact members extending towards the rearward edges of the operating and fixed sash frames for maintaining sealing contact therewith when said window structure is maintained in closure.

8. The invention of claim 5 wherein said face flanges include contact members that extend towards the formed shoulders to maintain sealing contact therewith when said window structure is maintained in closure.

9. A window structure for a building and of the type wherein its window frame presents a narrow profile and is substantially concealed behind the facade of the outwardly opening operating sash, said window structure incorporating a glazed operating sash, a perimeter frame peripherally surrounding said operating sash and capable of being permanently mounted to the building structure, said perimeter frame having jamb, sill and head portions, said portions being of uniform semi-tubular structure and when viewed exteriorly being of uniform dimensions, the glazed operating sash being hingedly mounted to the perimeter frame forming said operating sash opening and capable of being opened outwardly with respect thereto, said operating sash being formed as a tubular like frame around its perimeter and having a reglet provided forwardly thereof for securing the glaze firmly in place, the reglet of the operating sash having an integral face flange extending outwardly therefrom, said face flanges having a width substantially less than the width of said portions, said operating sash when maintained in closed position having its face flanges substantially concealing the tubular like frame and perimeter frame therebehind, said perimeter frame having a formed shoulder around its periphery and extending inwardly thereof, the face flanges of the operating sash retaining a sealing contact with said shoulders when said sash is maintained in closed position, rear flanges extending inwardly from the inner edges of said perimeter frame, said rear flanges being disposed in contiguity with and substantially concealing the rearward edges of the operating sash frame as retained proximate thereto when in closure, and said rear flanges of the perimeter frame being aligned with the face flanges of the operating sash frame when said operating sash is maintained in closure.

10. The invention of claim 9 wherein said rear flanges include contact members extending towards the rearward edges of the operating sash frame for maintaining sealing contact therewith when said window structure is secured in closure.

11. The invention of claim 9 wherein said face flanges include contact members that extend towards the formed shoulders to maintain sealing contact therewith when said window structure is maintained in closure.

12. The invention of claim 9 wherein a pair of operating sashes hingedly mount to the perimeter frame forming the operating sash opening, said pair of sashes opening exteriorly away from each other, an intermediate frame member of tubular like structure provided between said sashes and being fixed to said perimeter frame thereby forming a pair of operating sash openings, said intermediate frame having a surface provided thereon for retaining a sealing contact with the proximate face flanges of the pair of operating sashes when said sashes are maintained in closed position.

13. The invention of claim 12 wherein said face flanges include contact members that extend towards the formed shoulders and intermediate frame surface to maintain sealing contact therewith when said window structure is maintained in closure.

14. The invention of claim 11 wherein said rear flanges include contact members extending towards the rearward edges of the operating sash frame for maintaining sealing contact therewith, whereby the contacting members of both the face flanges and the rear flanges maintain a double sealing contact with their respective shoulders and rearward edges of the operating sash frame as when the window structure is secured in closure.

* * * * *